US008434462B2

(12) United States Patent
Chen

(10) Patent No.: US 8,434,462 B2
(45) Date of Patent: May 7, 2013

(54) DIRECT GAS INJECTION SYSTEM FOR FOUR STROKE INTERNAL COMBUSTION ENGINE

(76) Inventor: Chi Keng "George" Chen, Fremont, CA (US)

( * ) Notice: Subject to any disclaimer, the term of this patent is extended or adjusted under 35 U.S.C. 154(b) by 0 days.

(21) Appl. No.: 13/276,226

(22) Filed: Oct. 18, 2011

(65) Prior Publication Data

US 2012/0031356 A1 Feb. 9, 2012

(51) Int. Cl.
*F02B 25/00* (2006.01)

(52) U.S. Cl.
USPC ..... 123/534; 123/76

(58) Field of Classification Search ..... 123/534, 123/525, 527, 531, 316, 317, 318, 76
See application file for complete search history.

(56) References Cited

U.S. PATENT DOCUMENTS

| | | | | |
|---|---|---|---|---|
| 1,752,082 | A * | 3/1930 | Herkt | 60/605.1 |
| 4,765,304 | A * | 8/1988 | Brown | 123/532 |
| 5,067,467 | A * | 11/1991 | Hill et al. | 123/525 |
| 5,315,973 | A * | 5/1994 | Hill et al. | 123/525 |
| 7,004,116 | B2 * | 2/2006 | Allen | 123/531 |

* cited by examiner

*Primary Examiner* — Hieu T Vo
(74) *Attorney, Agent, or Firm* — Shalini Venkatesh

(57) ABSTRACT

A method for operating a four-stroke internal combustion engine and a four-stroke combustion engine configured to be operated by the same are disclosed. The method comprises injecting compressed gas into a cylinder during the exhaust stroke of the combustion cycle. In another aspect of the invention, the injection occurs at a time in the combustion cycle near the end of the exhaust stroke, the cylinder approaching Top Dead Center. In a still further aspect of the invention, the gas comprises air.

19 Claims, 6 Drawing Sheets

DIRECT GAS INJECTION SYSTEM FOR FOUR STROKE INTERNAL COMBUSTION ENGINE

FIELD OF THE INVENTION

Various embodiments of the invention described herein relate to the field of internal combustion engines for motor vehicles and, more particularly, to improved methods of operating such engines, and to the devices and components required to carry out these improved methods.

BACKGROUND OF THE INVENTION

The basic operational concepts of the internal combustion engine have remained largely unchanged for much of the past 130 years, since the patent issued to Karl Benz in 1886. Only relatively recently have developments in sensors and computer technology allowed rapid advances in combustion engine efficiency. The overall efficiency of the internal combustion engine driven vehicle, calculated across the entire energy chain "from oil well to wheels" is currently around 15%. Occupying a key position in this energy chain, the efficiency of a 4-stroke gasoline engine, the type of motor vehicle engine in most widespread use, is around 30%; for diesel fueled 4-stroke engines the efficiency is around 40%. These are laboratory efficiency numbers for engines operating at design capacity. In practice, especially for large engines operating under partial loads, the efficiencies are significantly lower, as evidenced by the low MPG numbers that characterize normally aspirated (i.e. non turbo-charged) gasoline sports cars. These cars are relatively lightweight, with large capacity engines, and parallel exhaust systems. Nevertheless, the efficiencies realized by such cars are very low.

Any improvement in the efficiency of four-stroke engines is highly desirable, on the grounds of direct and indirect costs to the user and the environment.

Engine efficiency may be improved by addressing input or output aspects of the combustion process. Direct fuel injection and variable input valve timing are well known and well developed examples of the former. The current invention addresses the output aspect, proposing a novel method of residual exhaust gas management.

Ideally, at the end of the exhaust stroke of a 4-stroke engine, all the gas in the cylinder space would be completely expelled. This may indeed happen in the engines of race cars, where the exhaust port of each cylinder voids to the outside air in a very short distance, without having to pass through the restrictions of a muffler or catalytic converter. Also, as these cars run at very high speeds, significant vacuum suction is generated at the exhaust port, which contributes to drawing virtually all the gas out of the cylinder at the end of each exhaust stroke.

However, in a standard transportation vehicle, whether fueled by diesel or gasoline, the exhaust pathway is not so unrestrained. It typically includes a muffler to reduce emitted noise, and a catalytic converter to convert unburned CO, hydrocarbons, and $NO_{(x)}$ to $CO_2$, $H_2O$, and Nitrogen. While they provide valuable protective functions, these introduced devices act to restrict the outflow of exhaust gases, creating significant back pressure at the cylinder exhaust port. One current manufacturer of diesel engines actually adds ammonia into the exhaust pathway to react with particulate matter in the exhaust stream and thus avoid emission of that matter into the environment. All such attempts to reduce the emitted pollution have the unfortunate effect of increasing back pressure, which, as indicated in FIG. 1, prevents all the gas from being expelled at the end of the exhaust stroke. The residual oxygen-depleted gas in effect dilutes the air taken in at the next intake stroke, as shown in FIG. 2. This in turn obviously reduces efficiency from the value it could theoretically achieve if all of the gas mixture to be compressed and combusted were freshly input oxygen-containing air.

A more detailed description of the relevant processes is given in the "Detailed Description of the Invention" section following, but as an illustrative quantitative example, consider a typical cylinder compression ratio of 10:1 and an "ideal" back pressure of 1 Atm. In this case, there will be a volumetric dilution of about 10% causing a corresponding lowering of the engine efficiency relative to its potential ideal of 10%. Higher back pressures causing greater dilution will result in correspondingly greater drops in efficiency. For simplicity, this analysis ignores the complication that gas densities drop as temperature rises, so at a typical high exhaust temperature of around 700 degrees C., the density of the residual gas may be only 50% of the density of the input gas at room temperature. However, a typical back pressure is likely to be closer to 2 Atm than 1 Atm, and in the case of diesel engines, back pressures of 3 Atm or even 4 Atm have been reported. Therefore, the simplified estimates above regarding dilution and efficiency are not only reasonable but conservative.

One current approach to improving the outflow of exhaust gas is to reduce back pressure by providing an exhaust port header that creates a cancelling back pressure by collecting the output from all the cylinders in a 4:1 junction and reflecting a "combined" pressure back to the exhaust ports. This type of approach is not only complicated and costly, but also can only work well for an engine running at a fixed rpm value, actually increasing back pressure at other values. It may be advantageous for airplane engines, which do effectively operate at a fixed rpm, but is not really useful for standard variable rpm car engines. Another current approach provides multiple parallel exhaust pathways (e.g. dual or quadruple exhaust systems). This incurs significant penalties in weight, cost, and size.

The trend towards increasingly stringent anti-pollution requirements is likely to exacerbate the problem of exhaust back pressure lowering car engine efficiency. What is needed is a method of improving the outflow of residual oxygen-depleted gases from the cylinders without adding heavy components or interfering with the functions of devices in the exhaust system that reduce emitted noise and pollutants.

It should be noted that the current application is directed to four-stroke engines, not two-stroke ones. The latter use a process called scavenging to flush out exhaust gas, introducing a fresh charge of fuel/air mixture mid-way through the power stroke. The inflow of this mixture forces spent, combusted gas out through the exhaust port but also inevitably forces some non-combusted fuel out as well as a significant amount of burned lubrication oil. The polluting problems of such engines are obviously great, and are not addressed by the proposals disclosed in this application.

SUMMARY OF THE INVENTION

The present invention includes a method for operating a four-stroke internal combustion engine, and an internal combustion engine configured to be operated by the same. The method comprises injecting compressed gas into a cylinder during the exhaust stroke of the combustion cycle. In another aspect of the invention, the injection occurs at a time in the combustion cycle near the end of the exhaust stroke, the cylinder approaching Top Dead Center. In a still further aspect of the invention, the gas comprises air.

In yet another aspect of the invention, an internal combustion engine system is disclosed. The system comprises a cylinder that includes an air intake port, a compressed gas injection port, and an exhaust port. The system also comprises a compressed gas injector operably connected to the compressed gas injection port.

DETAILED DESCRIPTIONS OF SOME EMBODIMENTS

The present invention has been made in view of the problems discussed in the "Background of the Invention" section above. As will be explained in detail below, the invention is directed towards improving the efficiency of standard four-stroke internal combustion engines by the direct injection of compressed gas into the engine cylinders during the exhaust stroke of the combustion cycle, the injected gas being at a pressure sufficiently high to expel into the exhaust system a large fraction of residual gas, that would otherwise remain in the cylinders without contributing to power generation.

Figure 1:
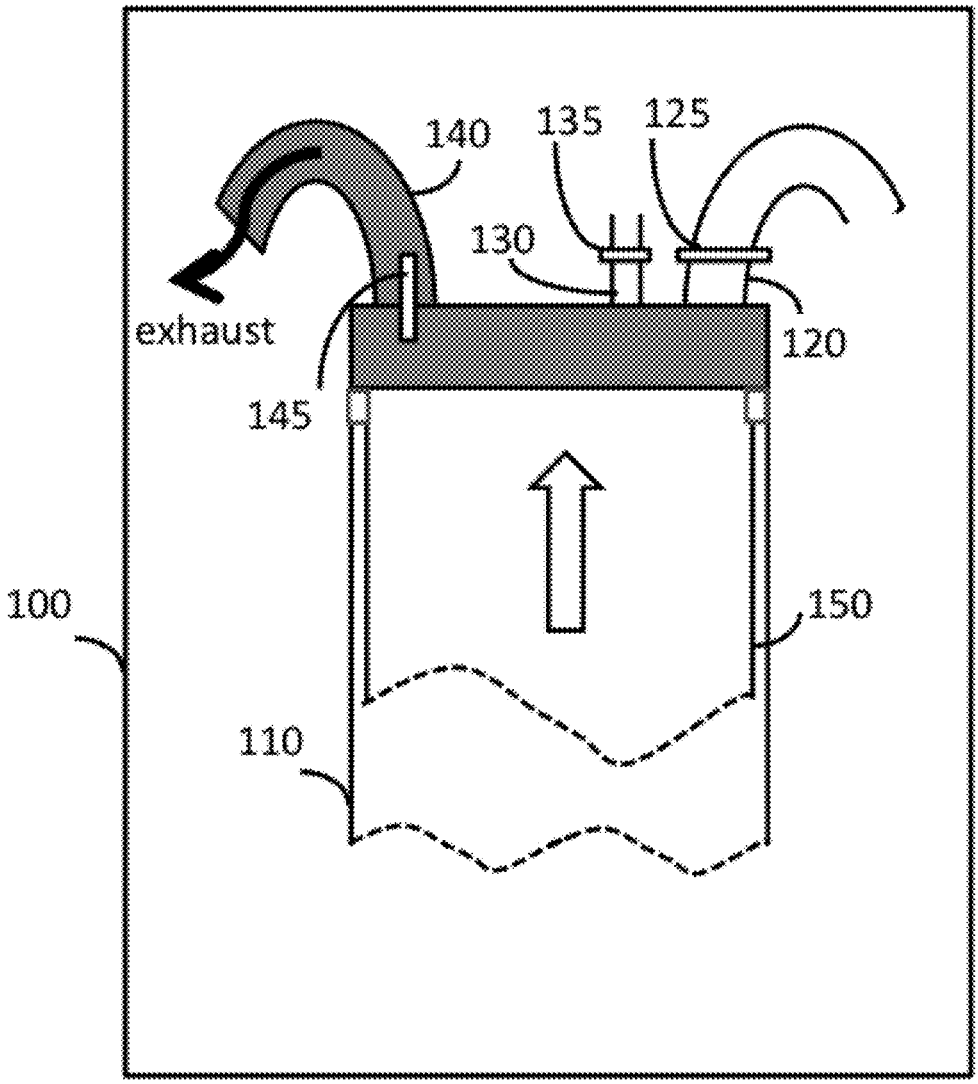
Figure 1 (Prior Art)
FIG. 1 shows a simplified schematic view of a prior art engine at a point just before the end of the exhaust stroke.
Figure 2:
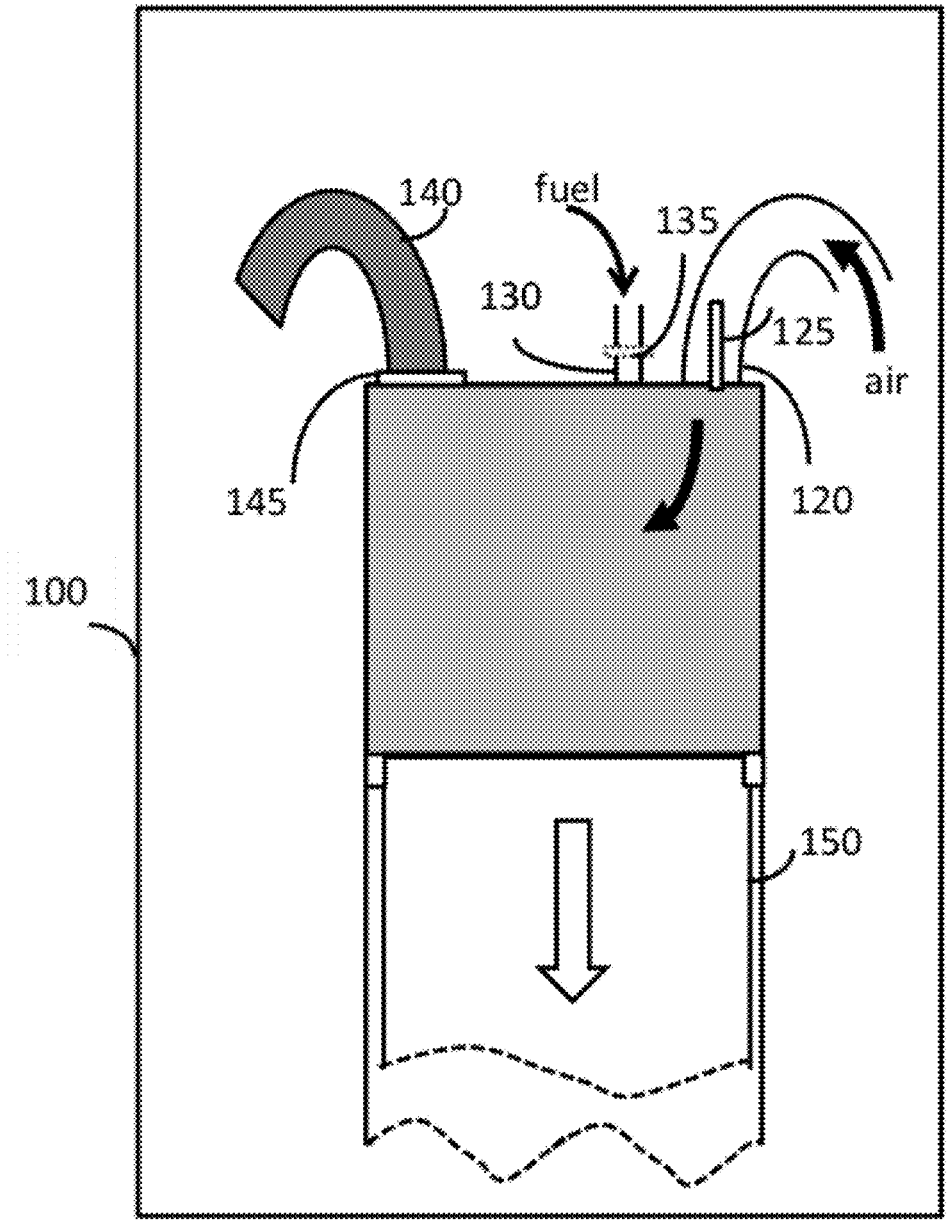
Figure 2 (Prior Art)
FIG. 2 shows a simplified schematic view of a prior art engine at a point during the intake stroke.

As illustrated schematically in FIGS. 1 and 2, each cylinder 110 of a typical prior art combustion engine 100 (only one cylinder is shown for simplicity) has an air intake port 120, a direct fuel injection port 130, and at least one exhaust port 140, served by corresponding valves 125, 135 and 145 respectively. Close to the end of the exhaust stroke of each cycle, the situation shown in FIG. 1, the cylinder piston 150 is at or almost at the top of its range of motion (TDC), and exhaust valve 145 is open, but back pressure at the exhaust port 140 results in a residual volume of spent, combusted gas remaining present on the cylinder side of the exhaust port. As this gas has already experienced combustion, it is oxygen-depleted, and may contain combustion-generated impurities.

FIG. 2 shows the situation for engine 100 in the intake stroke following the exhaust stroke described above, after the exhaust valve 145 closes. The piston 150 moves down as the air intake valve 125 opens. The residual gas mixes with the air entering through air intake port 120 to fill the cylinder. Fuel may be directly injected through port 135 at an appropriate point during the four stroke cycle. Compression and combustion strokes following the intake stroke will, of course, release energy, but the amount of energy released will be smaller than the amount that could be released if the mixture filling the cylinder at the end of the intake stroke had contained oxygen at the full concentration present in air, rather than being "diluted" with combusted gases.

It should be noted that if the technique of variable input valve timing mentioned in the Background of the Invention section above is used, the input valve may open slightly before the exhaust valve closes. This only has a relatively small effect on flushing out exhaust gas, because in normally aspirated engine systems the pressure at the air intake valve 125 is no higher than the back pressure at the exhaust port 140. Turbo-charged systems operating at full load offer some improvement as they provide a higher input pressure and so increase the flushing. However, there is still much room for improvement.

Figure 3:
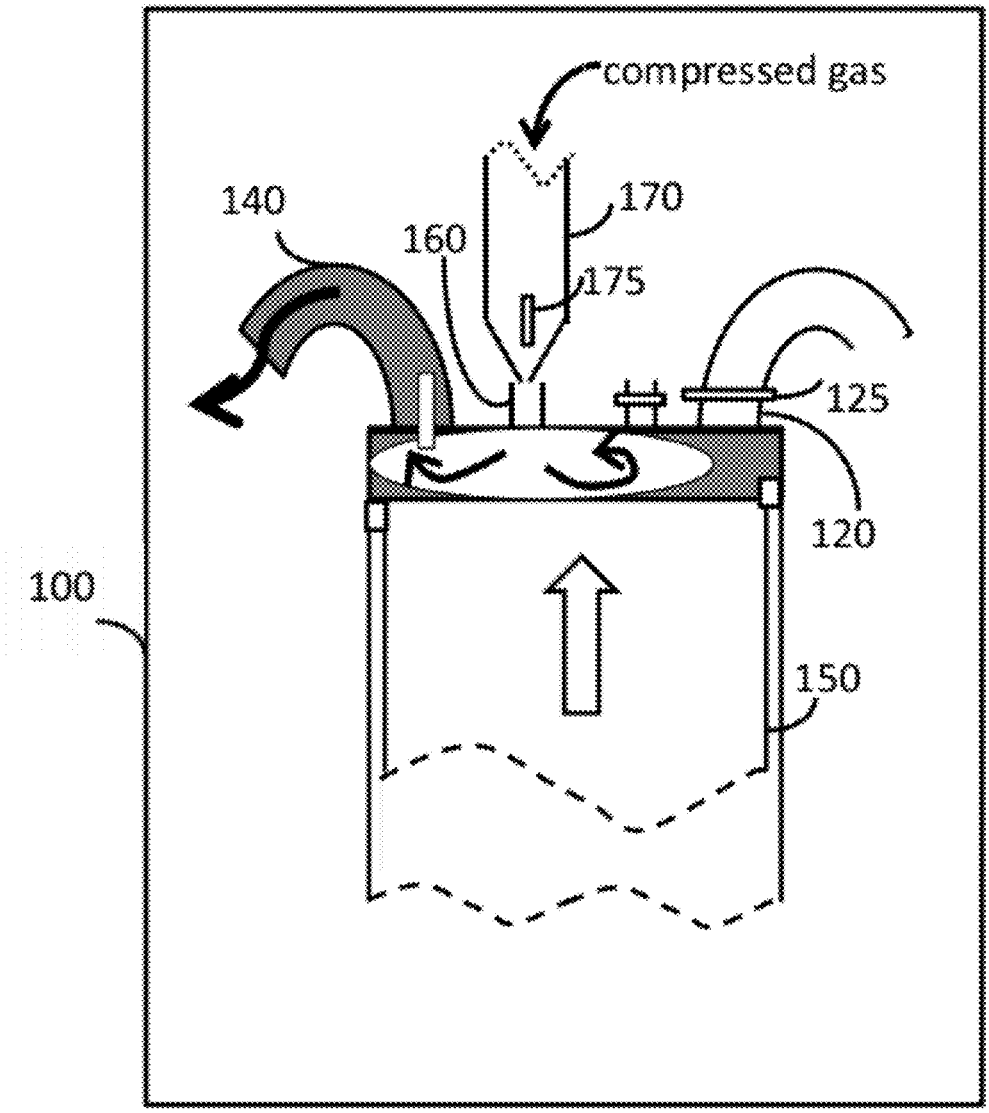
FIG. 3 shows a simplified schematic view of an engine according to one embodiment of the present invention at a point just before the end of the exhaust stroke.

Refer now to FIG. 3, a schematic view of one embodiment of the present invention. A combustion engine 100 is shown at a time in the 4-stroke cycle corresponding to that shown in FIG. 1. In this embodiment, a gas injection port 160 is included at the top of the cylinder. As the piston 150 approaches the top of its range of motion, when the exhaust valve 145 is still open, a valve 175 in a gas injector 170 operably connected to the gas injection port 160 is opened to allow the entry into the cylinder of a burst of compressed gas. This compressed gas, which in one embodiment is compressed air, has a flushing effect on the residual gas, ideally forcing all or almost of all the residual gas from the chamber out through the exhaust port 140. Appropriate design of the gas injector and the gas injection port would enhance this flushing effect. The mixture remaining at the top of the cylinder at the end of the exhaust stroke is therefore primarily the gas input through port 160, rather than the products of combustion. In the embodiment where the gas input Is air, the residual mixture will have a composition very close to air.

Figure 4:
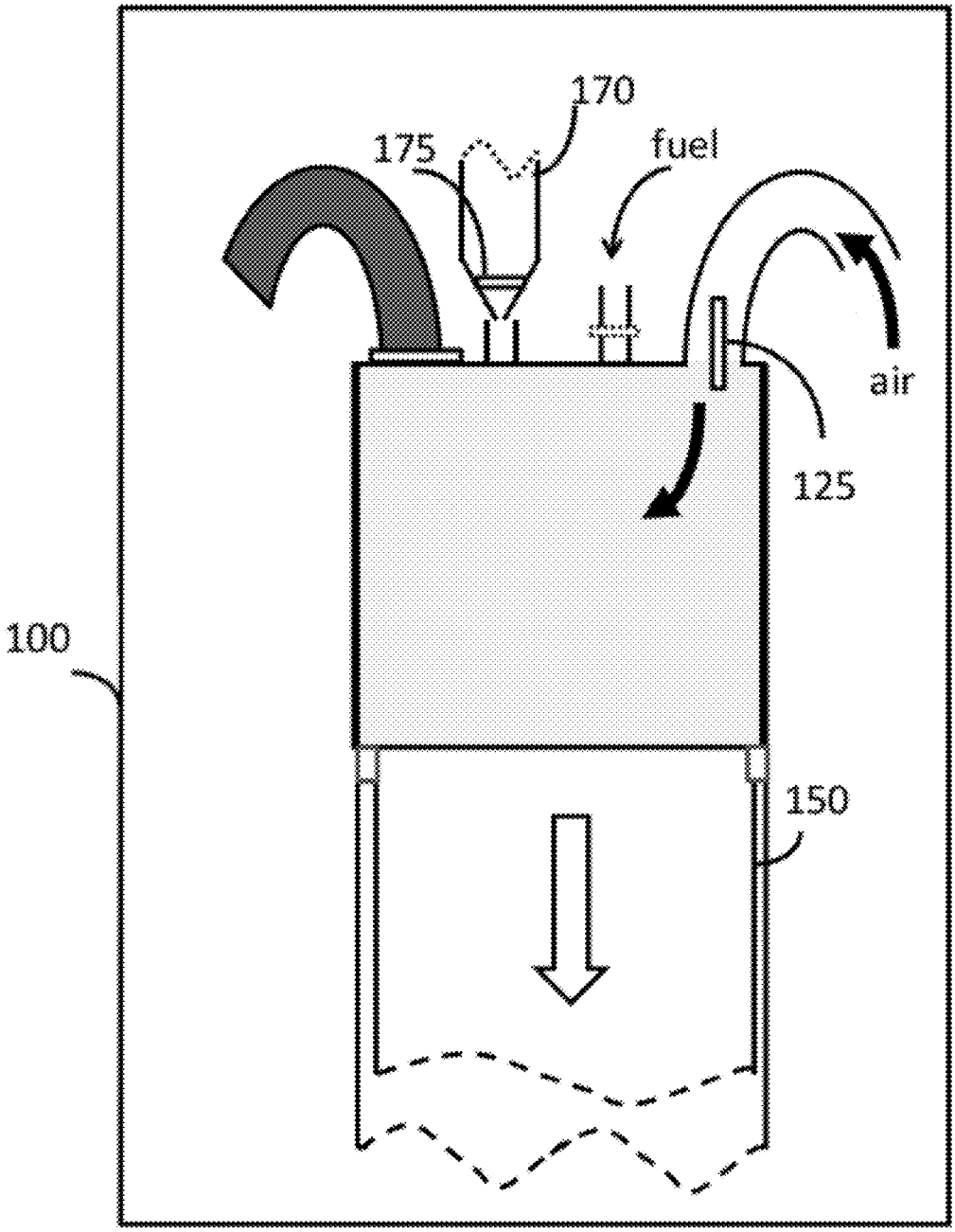
FIG. 4 shows a simplified schematic view of an engine according to one embodiment of the present invention at a point during the intake stroke.

During the subsequent air intake stroke, shown in FIG. 4 at a point roughly corresponding to that shown in FIG. 2, the gas injector valve 175 is closed and the normal air intake valve 125 opened, as the piston 150 moves down. As the mixture of gases remaining in the chamber just before the input stroke of the new cycle was almost exactly the same as that to be drawn into the chamber during that input stroke, the "dilution" experienced by the indrawn air is close to zero. The composition of the gas mixture in the cylinder ready for the following compression and combustion strokes is therefore very close to that of air, with its corresponding concentration of oxygen. Also, insignificant amounts of impurities generated during the compression and combustion phases of the previous cycle remain in the cylinder to cause problems.

The exact pressure to which the gas to be injected must be compressed is not critical, but it should be sufficiently high to force out the majority of the "combusted" residual gas remaining at the top of the cylinder. Consider a typical case where the exhaust back pressure is 1 Atm and the residual gas, in the absence of the present invention, would occupy about 10% of the volume of the cylinder at the end of the following intake stroke. The concentration of oxygen in the cylinder at that time, due to the combination of fresh air and residual gas would be 90% of its ideal (i.e. pure air) value. Now consider the injection of compressed air just before the very end of the exhaust stroke, according to one embodiment of the present invention. If the compressed air were to be injected at a pressure of 10 Atm, approximately 90% of that residual gas would be expelled. The remaining 10% would occupy only about 1% of the full volume of the cylinder, and the concentration of oxygen in the cylinder at the end of the following intake stroke would be 99% of its ideal (i.e. pure air) value. The improvement in efficiency would therefore be the relative difference between 90% and 99%, i.e. 10%.

Under partial load conditions, where the air intake pressure is lower than 1 Atm, increases in efficiency even greater than 10% could be achieved by flushing the exhaust at 10 Atm. For turbocharged engines, where efficiency is intrinsically higher because the normal air intake is compressed to a value of around 1.5 Atm, allowing more oxygen and fuel to be combusted per cycle, the corresponding improvement in efficiency would be expected to be less than 10%.

In general, the improvement in efficiency to be expected by implementing direct gas injection as described herein will be greatest in cases where the engine is of large capacity, operating under low partial load, fueled by gasoline, having a restricted exhaust system, and being normally aspirated. The improvement to be expected will be lowest for an engine of small capacity, operating at maximum load, fueled by diesel, having a non-restricted exhaust system, and a turbocharger.

The design and manufacture of the gas injector are not expected to be problematic, as technologies to handle compressed gases in the pressure ranges and low volumes relevant to this application are well developed. In comparison to the complexities of direct fuel injection systems in particular, which have already been met, the challenges presented are not great. Indeed, lessons learned from the development of highly reliable and fast responding fuel injection systems are likely to be of direct benefit in the design and manufacture of compressed gas injectors suited to embodiments of the present invention. The volume of gas to be injected is low compared to the volume of the chamber, but large relative to the volume of fuel injected. A nozzle significantly larger than the fuel injector nozzle is therefore required.

Figure 5:
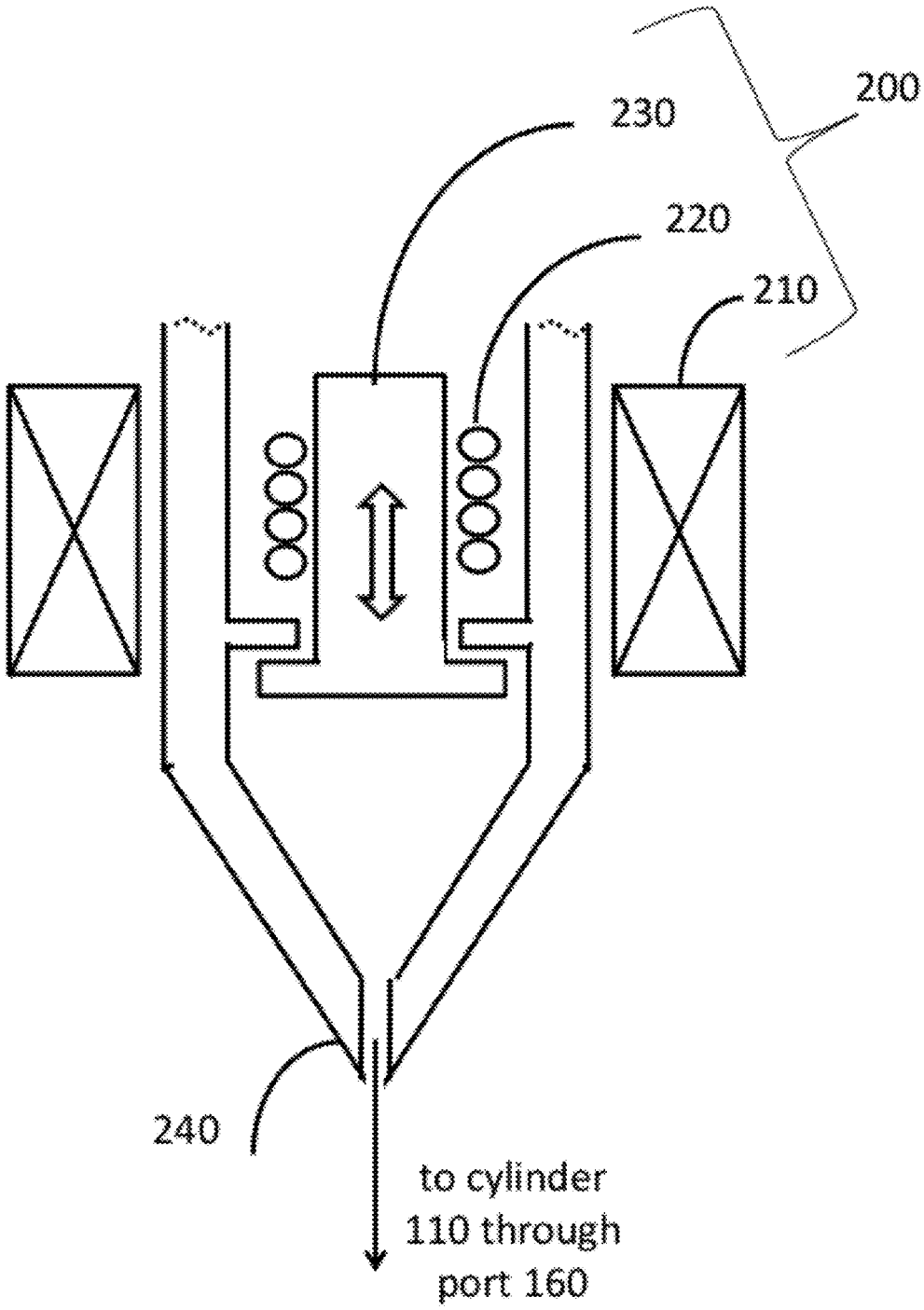
FIG. 5 shows a simplified schematic view of a compressed gas injector according to one embodiment of the present invention.

In one embodiment, as shown schematically in FIG. 5, the compressed gas injector 170 may include an electromagnetic actuator 200, which may include coil 210 spring 220 and piston 230. In another embodiment, where the engine may be operating at very high rpm and the trade-off between speed and load bearing is justified, a piezoelectric actuator (not shown) may be used in preference to an electromagnetic actuator, serving the same purpose of controlling the injection of compressed gas through nozzle 240 and port 160 into cylinder 110. The design and operational details of electromagnetic and piezoelectric actuators are well known in the art and will not be discussed further here.

In one embodiment, the gas injector is located next to the fuel injector, as shown in FIGS. 3 and 4. This position has the advantage of being at a relatively low temperature, as the engine head is typically water cooled. In another embodiment, not shown in the figures, the injector may be placed on the opposite side of the chamber to the exhaust port and oriented in a way to maximize the flushing effect. However, any other position allowing easy access to the top of the cylinder could be used.

In some embodiments, the injected gas could be an inert gas such as Argon, Nitrogen, Neon, etc rather than air. Inert gases would not provide the oxygen necessary to achieve the maximum efficiency improvement, but would serve a secondary purpose in flushing out impurities. The inert gas could be selected on the basis of thermal properties such as specific heat ratio that could also have some effect in improving engine efficiency.

Figure 6:
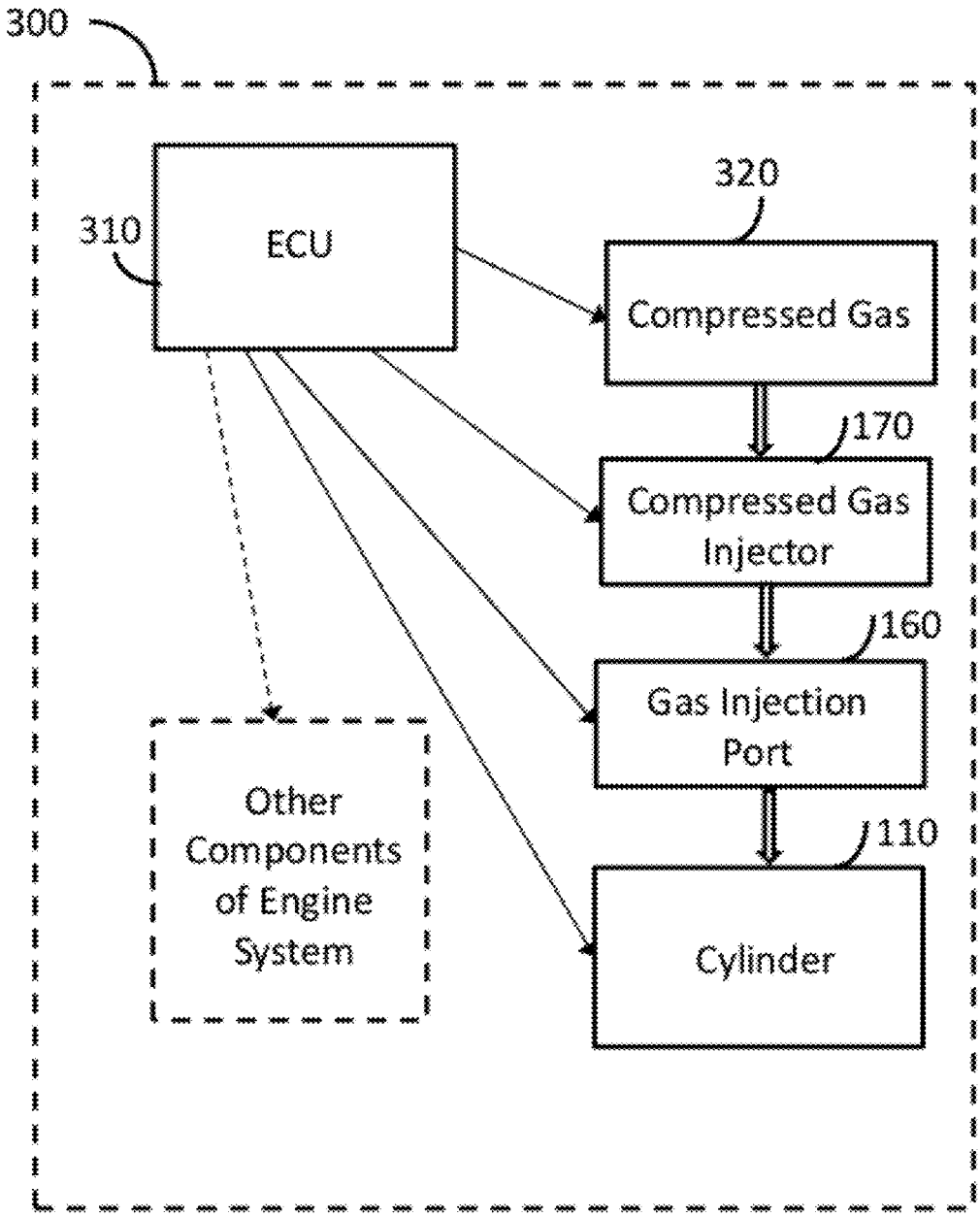
FIG. 6 shows a simplified block diagram of an engine system according to one embodiment of the present invention.

Modern engine systems include an electronic control unit (ECU) that controls many aspects of engine operation. In one embodiment of the invention, as shown in FIG. 6, the engine system 300 includes an ECU 310 which controls the operation of the compressed gas injector 170 to deliver compressed gas from a source 320 through the compressed gas injection port 160 into the cylinder 110 at times that are appropriately synchronized with the combustion cycle of the engine. In the embodiment shown, the source of compressed gas is dedicated to the flushing function described above. In another embodiment, the source of compressed gas 220 may already exist within the vehicle system, delivering gas to other components such as a turbocharger. If the source already exists, correspondingly less effort and cost are required to implement the present invention, making the potential energy savings even more attractive.

The above-described embodiments should be considered as examples of the present invention, rather than as limiting the scope of the invention. Various modifications of the above-described embodiments of the present invention will become apparent to those skilled in the art from the foregoing description and accompanying drawings. Note further that included within the scope of the present invention are methods of making and having made the various components, devices and systems described herein.

Accordingly, the present invention is to be limited solely by the scope of the following claims.

The invention claimed is:

1. An internal combustion engine system comprising:

a cylinder comprising;

an air intake port;

a compressed gas injection port; and an exhaust port;

a compressed gas injector operably connected to the compressed gas injection port; and an electronic control unit (ECU) configured to control the operation of the compressed gas injector to deliver compressed gas through the compressed gas injection port into the cylinder at times synchronized with the combustion cycle of the engine to facilitate expulsion of residual exhaust gas through the exhaust port.

2. The system of claim 1, wherein the compressed gas injector delivers compressed gas through the compressed gas injection port into the cylinder at a pressure of at least 3 Atm.

3. The system of claim 1, wherein the compressed gas injector delivers compressed gas through the compressed gas injection port into the cylinder at a pressure of between 3 Atm and 15 Atm.

4. The system of claim 1, wherein the compressed gas injector delivers compressed gas through the compressed gas injection port into the cylinder, the compressed gas comprising air.

5. The system of claim 1, wherein the compressed gas injector delivers compressed gas through the compressed gas injection port into the cylinder, the compressed gas comprising approximately 20% by volume of Oxygen.

6. The system of claim 1, wherein the compressed gas injector delivers compressed gas through the compressed gas injection port into the cylinder, the compressed gas comprising an inert gas.

7. The system of claim 1, wherein the compressed gas injector includes an electromagnetic actuator.

8. The system of claim 1, wherein the compressed gas injector includes a piezoelectric actuator.

9. The system of claim 1, wherein the gas injection port is included in the body of the cylinder adjacent a fuel injection port.

10. The system of claim 1, wherein a fuel injection port is included in the body of the cylinder at an intermediate position between the exhaust port and the compressed gas injection port.

11. The system of claim 1, further comprising a source of compressed gas.

12. A method for operating a four-stroke internal combustion engine, the method comprising injecting compressed gas into a cylinder during the exhaust stroke of the combustion cycle.

13. The method of claim 12 wherein the injection occurs at a time in the combustion cycle near the end of the exhaust stroke, the cylinder approaching Top Dead Center.

14. The method of claim 12 wherein the gas is injected at a pressure of at least 3 Atm.

15. The method of claim 14 wherein the pressure of the injected gas is between 3 Atm and 15 Atm.

16. The method of claim 12 wherein the gas comprises air.

17. The method of claim 12 wherein the gas comprises approximately 20% by volume of Oxygen.

18. The method of claim 12 wherein the gas comprises an inert gas.

19. The method of claim 12, wherein the gas injection occurs through a gas injection port in the body of the cylinder, a gas injector being operably connected to the gas injection port.

* * * * *